United States Patent [19]

Cogbill, II

[11] 4,020,850

[45] * May 3, 1977

[54] THERMOPLASTIC CIGARETTE WRAPPER

[75] Inventor: Philip Hancock Cogbill, II, Louisville, Ky.

[73] Assignee: Brown & Williamson Tobacco Corporation, Louisville, Ky.

[ * ] Notice: The portion of the term of this patent subsequent to Sept. 30, 1992, has been disclaimed.

[22] Filed: July 17, 1975

[21] Appl. No.: 596,850

Related U.S. Application Data

[63] Continuation-in-part of Ser. No. 426,677, Dec. 12, 1973, Pat. No. 3,908,671.

[52] U.S. Cl. ..... 131/15 R; 131/2; 131/17 R; 162/139

[51] Int. Cl.[2] ..... A24D 1/02

[58] Field of Search ..... 131/2, 15 R, 17 R, 140 R, 131/140 C, 142–144; 162/139

[56] References Cited

UNITED STATES PATENTS

| | | | |
|---|---|---|---|
| 2,171,986 | 9/1939 | Poetschke | 131/15 R |
| 2,809,904 | 10/1957 | Koree | 131/15 R |
| 2,840,085 | 6/1958 | Detert | 131/140 R |
| 3,003,895 | 10/1961 | Grunwald | 131/17 R |
| 3,251,368 | 5/1966 | Neurath | 131/15 R |
| 3,380,458 | 4/1968 | Touey et al. | 131/17 R |
| 3,416,537 | 12/1968 | Townend | 131/140 C |
| 3,424,169 | 1/1969 | Moren | 131/140 C |
| 3,477,865 | 11/1969 | Armbrust et al. | 131/17 R |
| 3,820,548 | 6/1974 | Buchmann et al. | 131/2 |
| 3,908,671 | 9/1975 | Cogbill | 131/15 R |

OTHER PUBLICATIONS

Sax; N. Irving, Dangerous Properties of Industrial Materials, 3rd ed., Reinhold Book Corp., N. Y., pp. 960–961 (1968).

*Primary Examiner*—Robert W. Michell
*Assistant Examiner*—T. S. Gron
*Attorney, Agent, or Firm*—William J. Mason

[57] ABSTRACT

A cigarette wrapper comprising a microporous sheet formed from a cellulose derivative binder filled with finely ground paper. The wrapper also includes a small amount of potassium nitrate. Such cigarette wrappers are effective to selectively reduce the nicotine delivery from normal cigarette tobacco blends.

26 Claims, No Drawings

THERMOPLASTIC CIGARETTE WRAPPER

REFERENCE TO RELATED APPLICATION

This application is a continuation-in-part of application Ser. No. 426,677, filed Dec. 12, 1973, now U.S. Pat. No. 3,908,671.

FIELD OF THE INVENTION

The present invention pertains to porous thermoplastic cigarette wrappers which are effective to selectively reduce the nicotine delivery from normal cigarette tobaccos. More specifically, the present invention pertains to cigarette wrappers comprising a cellulosic binder filled with finely ground paper and a small amount of potassium nitrate. The filler may also include a whitener. The present invention also pertains to a smoking article comprising a smokeable material contained within the thermoplastic wrapper.

BACKGROUND OF THE INVENTION

There are numerous techniques available for reducing the nicotine delivery from tobacco smoke. However, most of these techniques also result in the reduction of tar delivery. For various reasons, such as achieving pleasant taste from tobacco smoke, it is desirable to be able to selectively reduce tar or nicotine delivery, i.e., to reduce tar or nicotine delivery relative to each other. The cigarette wrapper of the present invention provides means for selectively reducing nicotine delivery.

Tobacco foils prepared from cellulose derivative binders filled with finely ground tobacco are well known in the art. For example, U.S. Pat. Nos. 1,716,250; 2,485,670; 2,598,680; 2,706,695; 2,797,689; 2,830,597; 2,893,400; 2,897,103; 2,927,588; 2,955,601; 3,062,688; 3,288,148; and 3,43,546 all disclose tobacco foils prepared from finely ground tobacco dispersed in a matrix of a cellulosic binder. Typical binders include cellulose esters or cellulose ethers such as methyl cellulose, carboxymethyl cellulose, or cellulose acetate. Generally, such tobacco foils are disclosed as useful as cigar wrappers. However, foils prepared from cellulose derivative binders filled with ground tobacco have also been proposed as cigarette wrappers. See German Offen. 2,008,150.

None of the patents referred to above pertaining to tobacco filled foils suggests substituting a finely ground paper filler for the finely ground tobacco filler. Certain of the above listed patents (e.g., German Offen. 2,008,150) disclose that the use of the tobacco foils as cigarette wrappers effects a reduction in tar and nicotine delivery. However, none of the prior art recognizes that such wrappers would be effective to selectively reduce nicotine delivery, i.e., decrease the nicotine delivery to a greater degree than the tar delivery, thereby increasing the tar/nicotine ratio. Furthermore, tobacco filled thermoplastic foils have not proven successful as cigarette wrappers. Tobacco filled foils impart a heavy, sour-sweet, or "stemmy" off-taste to cigarette tobacco smoke.

Inclusion of potassium nitrate in cigarette wrappers is also known in the prior art. U.S. Pat. No. 2,171,986 discloses adding potassium nitrate to conventional paper cigarette wrappers, in combination with certain other nitrogen containing compounds, to produce a mildly alkaline smoke. However, as noted in the patent, the inclusion of sufficient amounts of potassium nitrate, in the absence of other nitrogen containing compounds, to obtain the desired mildly alkaline smoke adversely affects the ash and burning qualities of the paper. According to the disclosure of this patent, cigarette paper ordinarily produces an acid smoke, while an alkaline smoke is supposedly less irritating.

A number of other patents, such as U.S. Pat. Nos. 1,983,530 and 2,091,598 disclose the addition of potassium nitrate, as a combustion rate accelerator, to cigarette wrappers prepared from regenerated cellulose films Neither of these patents suggest that $KNO_3$ has any effect on tar or nicotine delivery.

U.S. Pat. No. 3,699,972 discloses the use of combustion-accelerating agents, such as potassium nitrate, to treat preselected areas of cigarette wrappers. The combustion-accelerating agents cause the treated area of a cigarette wrapper to burn more rapidly than untreated surrounding areas so that increased air flow is obtained through the rapid burning areas. While such wrappers are effective to reduce tar and nicotine deliveries, such wrappers do not result in selective nicotine delivery reduction.

The porous thermoplastic wrappers of the present invention provide a method of selectively reducing the nicotine delivery from normal cigarette tobacco blends. In addition, unlike tobacco filled wrappers, the thermoplastic wrappers of the present invention do not impart a heavy, sour-sweet, or "stemmy" off-taste to cigarette tobacco smoke.

In the present specification, unless otherwise specified, all references to percentages of the various ingredients are by weight, based on the total weight of the composition.

SUMMARY OF THE INVENTION

The present invention pertains to a thin, microporous sheet suitable for use as a cigarette wrapper. The sheet comprises about 10% to about 45% by weight finely divided paper; about 1.5% to about 2.8% by weight potassium nitrate; up to about 40% by weight of a whitener; and about 20% to about 55% by weight of a thermoplastic binder. Suitable thermoplastic binders include cellulose derivatives such as cellulose esters and cellulose ethers or mixtures of cellulose esters and cellulose ethers.

The present invention also contemplates a smoking article comprising a smokeable material contained within a cigarette wrapper produced from the above-described thin porous thermoplastic sheet.

DESCRIPTION OF PREFERRED EMBODIMENTS

The type of paper used as a filler in the thermoplastic wrapper of the present invention is not critical. As used herein, the term"paper" refers to a felted sheet prepared from cellulosic or synthetic fibers (other than tobacco). Suitable papers include those made from flax, bagasse, esparto, straw, cotton, papyrus, bamboo, jute, hard woods, and soft woods. Paper is most commonly made from soft woods (coniferous trees) such as spruce, hemlock, pine, etc.

In the wrapper of the present invention, unfilled flax paper is preferred. Such papers are commercially available and commonly used as plug wraps in the cigarette industry. The paper is ground to a size of 100 mesh, preferably 140 mesh, or less to insure that it may be readily dispersed in the binder.

Amounts of paper greater than about 45% by weight normally would not be employed, because at such high paper contents, the wrapper lacks adequate strength. Amounts of a paper less than about 10% by weight are not desirable because the burning qualities of the wrapper are adversely affected. Preferably, the wrapper contains between about 20% and about 30% by weight finely divided pulverized paper.

The thermoplastic wrapper may optionally include additional fillers to enhance the whiteness of the sheet. The inclusion of fillers which enhance whiteness is not necessary. However, since cigarette wrappers normally are white, consumers expect such an appearance. Accordingly, a white wrapper is desirable to achieve consumer acceptance. Suitable whiteners include calcium carbonate, magnesium carbonate, aluminum hydroxide, talc, and titanium dioxide. When whiteners are included in the wrapper formulation, they may be added in amounts up to about 40% by weight, and preferably in amounts of from about 15% to about 30% by weight.

The wrappers of the present invention may also include minor amounts of additional fillers, such as powdered charcoal or powdered alumina. Such fillers may replace part of the finely divided pulverized paper but should not encompass more than about 20% by weight of the composition. Larger amounts should not be employed, as these relatively dense materials process poorly and give a less porous sheet.

The addition of potassium nitrate to the wrapper formulation enhances the selective nicotine reduction effect. In addition, the potassium nitrate acts as a burn accelerator, thereby controlling the puff number of, and reducing delivery of tar from, cigarettes employing the wrapper.

Amounts of potassium nitrate greater than about 2.8% by weight should not be employed. Since the $KNO_3$ strongly influences the cigarette free burn rate, larger amounts cause the cigarette to burn too rapidly. At least about 1.5% by weight potassium nitrate should be included in the wrapper formulation to achieve a desired burn rate and the beneficial enhanced selective nicotine reduction effect. Preferably, the potassium nitrate is employed in amounts of from about 1.7% to about 2.5% by weight.

Oxidizers other than potassium nitrate, such as potassium chlorate, sodium chlorate, calcium peroxide and colloidion (cellulose nitrate) are not suitable. When such oxidizers are used in place of potassium nitrate the wrapper becomes too flammable and tends to flame rather than smolder. In addition, such oxidizers are relatively ineffective with respect to controlling burn rate.

The thin porous sheet of the present invention would normally include at least about 20% by weight of a thermoplastic binder. Lesser amounts of binder are not sufficient to give the sheet adequate integrity. Normally, the sheet would not include more than about 55% by weight binder, as larger amounts adversely affect burning characteristics. Preferably, the sheet contains from about 30% to about 40% by weight thermoplastic binder.

Any of the cellulose derivatives employed as binders with the tobacco filled foils described in the patent previously referred to are suitable for use with the present invention, provided processing techniques are controlled to give the desired degree of porosity. These cellulose derivatives include various cellulose esters and cellulose ethers, such as methyl cellulose, carboxymethyl cellulose, hydroxyethyl cellulose, ethyl cellulose, cellulose acetate, etc. A preferred binder comprises a mixture of methyl cellulose and cellulose acetate. Mixtures in which the cellulose acetate and methyl cellulose are present in ratios of from 2:1 to 20:1 parts by weight are particularly preferred.

Suitable cellulose derivatives should have a sufficient degree of substitution so that they are soluble in either water or organic solvents, or soluble in both organic solvents and water. The cellulose derivatives preferably yield, at relatively low concentrations, relatively high viscosity solutions. In addition, the cellulose derivatives should have a degree of polymerization such that they are capable of forming a coherent, tough sheet or mass when the aqueous or organic solvent is evaporated.

The degree of substitution refers to the average number of hydroxyl groups (out of the total of three groups) of each glucose unit of the cellulose polymer chain which have had the hydroxyl groups converted to either ester or ether radicals. For example, with respect to methyl cellulose, at least 1.6 of the three hydroxyl groups per polymer unit must be converted to methoxy groups before the polymer will become water soluble. Methyl cellulose having a degree of substitution greater than 2.0 is decreasingly soluble in water and increasingly soluble in non-polar solvents. Methyl cellulose having a degree of substitution of between about 1.6 and 2.0 is water soluble and also soluble in slightly polar organic solvents.

To obtain a less brittle and more workable sheet, from about 2% to about 15% by weight and preferably from about 6% to about 12% by weight, of a plasticizer may be included in the wrapper formulation. Any of the numerous well known plasticizers suitable for use with cellulose derivatives may be employed. Specific examples of suitable plasticizers are 1,3-butylene glycol, propylene glycol, glycerin, butylene glycol, triethylene glycol, etc. A preferred plasticizer is a mixture of 1,3-butylene glycol, propylene glycol and glycerin.

The wrappers of the present invention may be prepared by adding the binder to the suitable solvent to produce a swollen, gummy mass. Depending on the nature of the particular binder employed, any number of a wide variety of solvents may be employed. Ground paper is mixed into this mass along with potassium nitrate and, if desired, a whitener such as titanium dioxide. Additional solvent may be added to the resultant mixture to produce a free flowing slurry. If plasticizers are desired, they may be added to the free flowing slurry. The slurry is cast into sheets and dried to remove solvents. The cast sheets should be dried slowly and at relatively low temperatures so that microporous sheets are produced. If drying is effected at a temperature greater than about 80° C. non-porous sheets may result.

Sheets produced according to such a technique are particularly suitable for use as cigarette wrappers if process conditions are regulated to attain a thickness which approaches that of conventional cigarette paper. Preferably, the thickness of the sheet should be such that it is no more than five times heavier than conventional cigarette paper.

The processing technique also should be controlled so that the resultant sheet has a microporous structure to give a porosity of between about 5 and 60 Greiner, and preferably between 10 and 30 Greiner. As used herein, "microporous" refers to a sheet in which a majority (greater than 50%) of the pores have a diameter of 3 microns or less. A porosity within these parameters is important with respect to obtaining the properties desired in a cigarette wrapper, including selective nicotine reduction.

Porosity can be controlled within these limits by removing solvent from the cast sheet relatively slowly at relatively low temperatures (e.g., below 80° C.). Specific solvent removal techniques to achieve the desired porosity depend upon the particular solvent system employed. Preferably, binders and solvent systems are selected so that drying does not require the use of subatmospheric pressure.

The present invention will be further illustrated by the specific examples which follow. These examples are intended to illustrate preferred embodiments and are in no way limiting.

EXAMPLE I

Thermoplastic sheet preparation 7.5 parts by weight methyl cellulose (Dow Methocel 1500) and 26.8 parts by weight cellulose acetate (DuPont Plastacelle 09022) are slowly added to 472 parts by weight methylene chloride. The mixture is agitated to insure that all of the binders are completely wet. A swollen gummy mass forms, along with a small amount of free methylene chloride.

26.8 parts by weight titanium dioxide (National Lead Co. Titanox A WD) is added to the swollen gummy mass. The titanium dioxide thins the mixture slightly. 26.8 parts by weight paper (Ecusta E-592) which has previously been ground in a Wiley mill and screened to a size less than 140 mesh, is then added to the mixture.

In different batches, varying amounts of $KNO_3$ is added to the mixture. The amounts are varied from none to amounts sufficient to give, 1.7% by weight and 2.1% by weight, $KNO_3$ in the dried sheets.

53 parts by weight methanol are added slowly. The methanol completely dissolves the binder, forming a smooth, free flowing slurry. This mixture is allowed to sit for 30 minutes to an hour to allow the binders to swell.

The mixture is completed by adding plasticizers in amounts of 4.4 parts by weight 1,3-butylene glycol, 4.4 parts by weight propylene glycol, and 1.2 parts by weight glycerin. With thicker slurries, it may be necessary to add several drops of a surfactant, such as Span 20 or a defoamer such as SAG 470 to release any entrained air.

The slurry is cast onto a stainless steel sheet using a standard laboratory TLC spreader. The spreader is set for a 1.0 mm thickness sheet.

A commercial hairdryer, which reaches temperatures of 60°–70° C. is used to remove the solvents. The sheets are dried at low temperatures initially to prevent formation of a non-porous skin. Subsequent to drying, the thermoplastic sheet may be stripped from the stainless steel sheet. The resultant sheet has a color very close to that of normal cigarette paper with a smooth almost soft hand.

EXAMPLE 2

Cigarette Preparation and Smoke Analysis

Sheets made in accordance with Example 1 were cut into 90 × 29 mm sections and cigarettes were prepared using these sections as wrappers. Each cigarette contained approximately 850 mg. of a commercial cigarette tobacco blend and had a 21 mm. cellulose acetate filter affixed at one end.

A number of cigarettes prepared in this manner were smoked on a smoking machine and the smoke analyzed. The results of the smoke analysis are set forth in Table 1.

The data set forth in Table 1 demonstrates that the thermoplastic wrappers are effective to selectively reduce nicotine delivery. Relative to the control, all of the thermoplastic wrappers (Samples B. C. and D) resulted in a significant increase in the tar/nicotine ratio. Thus, it is apparent that the wrappers selectively reduced nicotine delivery relative to tar delivery.

As further shown by the data of Table 1, in wrappers which included potassium nitrate, the selective nicotine reduction effect was enhanced. That the addition of $KNO_3$ will enhance selective nicotine reduction is completely unexpected. As noted previously, the prior art has added $KNO_3$ to conventional cigarette wrappers to obtain a mildly alkaline smoke. Normally, the addition to tobacco of materials which will render the tobacco smoke more basic, increases nicotine delivery. See Elson et al, *Journal of the National Cancer Institute*, Vol. 48, No. 6, (June 1972) and Elson et al, *International Journal of Cancer*, Vol. 9 (1972), pp. 666–675. Thus, the addition of $KNO_3$ to the thermoplastic sheets of the present invention produces just the opposite of the expected effect on nicotine delivery, when such sheets are used as cigarette wrappers.

TABLE I

| SAMPLE | TAR (Mg./cig.) | NICOTINE (Mg./cig.) | $H_2O$ (Mg./cig.) | TAR/ NICOTINE RATIO | PUFFS | NO. OF CIGARETTES SMOKED |
|---|---|---|---|---|---|---|
| A. Control* | 12.4 | 1.01 | 2.2 | 12.3 | 9.0 | 20 |
| B. Ground Paper Filler | 26.0 | 1.66 | 6.5 | 15.6 | 12.7 | 90 |
| C. Ground Paper Filler 1.7% $KNO_3$ | 18.5 | 1.16 | 6.9 | 16.0 | 9.4 | 40 |
| D. Ground Paper Filler 2.1% $KNO_3$ | 14.3 | 0.87 | 3.2 | 16.4 | 8.0 | 50 |

*Conventional Cigarette Paper E-556 available from Ecusta Paper Division, Olin Mathieson Chemical Corporation Cigarettes prepared from wrappers produced in accordance with Example 1 were also smoked by smokers. Subjectively, the smokers found the paper filled thermoplastic wrap to be free of the heavy "stemmy" off-taste which is obtained from cigarettes prepared from tobacco filled thermoplastic wrappers. The cigarettes prepared from wrappers produced in accordance with Example 1 also gave a uniform char line and a white ash similar to conventional cigarette paper.

EXAMPLE 3

Additional thermoplastic sheets were prepared from formulations using 26.8 parts by weight cellulose acetate, and 7.5 parts by weight methyl cellulose as binders and 4.4 parts by weight 1,3-butylene glycol, 4,4 parts by weight propylene glycol and 1.2 parts by weight glycerin as plasticizers. The fillers employed with the binder system are set forth in Table II. All formulations were satisfactory as cigarette wrappers although the titanium dioxide-ground paper filler proved to be the most satisfactory.

EXAMPLE 4

To illustrate that potassium nitrate is not effective to selectively reduce nicotine when applied to conventional cigarette paper, a cigarette paper was treated so that it contained about 1.0% by weight potassium nitrate. Cigarettes were prepared from this treated paper, as well as from conventional cigarette paper which contains about 1% potassium citrate. Both the conventional paper (control) and the paper treated with potassium nitrate were formed into cigarettes and smoked on a smoke testing machine. Results of the analyses of the smoke are set forth in Table III. As is apparent from the data in this table, potassium nitrate on normal cigarette paper is not effective to selectively reduce nicotine.

TABLE II

WRAPPER FORMULATIONS

| | Fillers Parts By Weight | | | Oxidizer Parts by Wt. |
|---|---|---|---|---|
| | Titanium Dioxide | Finely Ground Paper Fiber (E-592) | Other | Potassium Nitrate |
| I | 26.8 | 26.8 | 0 | 2.1 |
| II | 26.8 | 13.4 | 13.4 Powdered Charcoal (Norit A) | 2.1 |
| III | 26.8 | 13.4 | 13.4 Powder-Alumina (Reynolds Metals -31) | 2.1 |

TABLE III

| | Tar/Nicotine | Tar | Nic. | Puffs |
|---|---|---|---|---|
| Conventional Cigarette Paper Treated To Include 1% $KNO_3$ | 14.8 | 13.6 | 0.92 | 7.0 |
| Control 1% K Citrate | 14.7 | 15.0 | 1.02 | 7.5 |

EXAMPLE 5

To demonstrate that papers other than unfilled flax may be used in the wrappers, sheets containing approximately 2.1% by weight $KNO_3$, were made using the formulation and procedure of Example 1, except that Kraft pulp and cotton linters were substituted for flax paper. Cigarettes formed from these sheets were smoked on a smoking machine and the smoke analyzed, in accordance with the technique of Example 2.

The data set forth in Table IV demonstrates that the wrappers are effective to selectively reduce nicotine delivery. Relative to the control, all of the thermoplastic wrappers (Samples B, C, and D) resulted in a significant increase in the tar/nicotine ratio.

Those skilled in the art will visualize many modifications and variations of the invention set forth above without departing from its spirit and scope. Accordingly, while the preferred embodiments of the invention have been described, it is understood that the invention is not confined to the specifics set forth by way of illustration.

TABLE IV

| SAMPLE | TAR (Mg./cig.) | NICOTINE (Mg./cig.) | TAR/ NICOTINE RATIO | PUFFS | FILTER EFFICIENCY (%) |
|---|---|---|---|---|---|
| A. Control* | 13.4 | 1.04 | 12.8 | 8.9 | 37.0 |
| B. Flax Fiber Filler | 17.1 | 0.74 | 23.1 | 8.0 | 42.6 |
| C. Cotton Linter Filler | 20.6 | 1.01 | 20.4 | 9.2 | 44.5 |
| D. Bleached Kraft Pulp Filler | 17.2 | 0.92 | 18.7 | 9.5 | 43.3 |

*Conventional Cigarette Paper E-566 available from Ecusta Paper Division, Olin Mathieson Chemical Corp.

What is claimed is:

1. A thin, microporous cigarette wrapper sheet having a porosity of between about 5–60 Greiner and in which at least 50 percent of the pores of said sheet have a diameter of no more than 3 microns, said sheet comprising:

a. about 10 percent to about 45 percent by weight finely divided unfilled paper having a size of 140 mesh or less;

b. about 1.5 percent to about 2.8 percent by weight potassium nitrate;

c. up to about 40 percent by weight of a whitener; and d. about 20 percent to about 55 percent by weight of a thermoplastic binder selected from the group consisting of cellulose esters, cellulose ethers, and mixtures thereof.

2. The thin, microporous sheet of claim 1 which comprises about 20 percent to about 30 percent by weight of said finely divided paper.

3. The thin, microporous sheet of claim 1 which comprises about 1.7 percent to about 2.5 percent by weight of said potassium nitrate.

4. The thin, microporous sheet of claim 1 which comprises about 15 percent to about 30 percent by weight of said whitener.

5. The thin, microporous sheet of claim 1 in which said whitener is selected from the group consisting of calcium carbonate, magnesium carbonate, aluminum hydroxide, talc, and titanium dioxide.

6. The thin, microporous sheet of claim 1 in which said whitener is titanium dioxide.

7. The thin, microporous sheet of claim 1 which comprises about 30 percent to about 40 percent by weight of said binder.

8. The thin, microporous sheet of claim 1 in which said binder is a mixture of methyl cellulose and cellulose acetate.

9. The thin, microporous sheet of claim 8 in which the ratio of cellulose acetate to methyl cellulose is between 2:1 and 20:1 parts by weight.

10. The thin, microporous sheet of claim 1 which includes from about 2 percent to about 15 percent by weight of a plasticizer.

11. The thin, microporous sheet of claim 10 which includes from about 6 percent to about 12 percent by weight of a plasticizer.

12. The thin, microporous sheet of claim 10 in which said plasticizer is a mixture of 1,3-butylene glycol, propylene glycol and glycerin.

13. A thin, microporous cigarette wrapper sheet having a porosity of between about 10–30 Greiner and in which at least 50 percent of the pores of said sheet have a diameter of no more than 3 microns said sheet comprising:

a. about 20 percent to about 30 percent by weight finely divided unfilled paper having a size of 140 mesh or less;
b. about 1.7 percent to about 2.5 percent by weight potassium nitrate;
c. about 15 percent to about 30 percent by weight titanium dioxide;
d. about 2 percent to about 15 percent by weight of a plasticizer; and
e. about 30 percent to about 40 percent by weight of a thermoplastic binder selected from the group consisting of cellulose esters, cellulose ethers and mixtures thereof.

14. The thin, microporous sheet of claim 13 in which said binder comprises from 2 to 20 parts by weight cellulose acetate and one part by weight methyl cellulose.

15. A smoking article comprising a smokeable material contained within the thin, microporous sheet of claim 13.

16. A smoking article comprising a smokeable material contained with a thin, microporous cigarette wrapper sheet having a porosity of between about 5–60 Greiner and in which at least 50 percent of the pores of said sheet have a diameter of no more than 3 microns said sheet comprising:

a. about 10 percent to about 45 percent by weight finely divided unfilled paper having a size of 140 mesh or less;
b. about 1.5 percent to about 2.8 percent by weight potassium nitrate;
c. up to about 40 percent by weight of a whitener; and
d. about 20 percent to about 55 percent by weight of a thermoplastic binder selected from the group consisting of cellulose esters, cellulose ethers and mixtures thereof.

17. The smoking article of claim 16 in which said wrapper comprises about 20 percent to about 30 percent by weight of said finely divided paper.

18. The smoking article of claim 16 in which said wrapper comprises about 1.7 percent to about 2.5 percent by weight of said potassium nitrate.

19. The smoking article of claim 16 in which said wrapper comprises about 15 percent to about 30 percent by weight of said whitener.

20. The smoking article of claim 16 in which said whitener of said wrapper is selected from the group consisting of calcium carbonate, magnesium carbonate, aluminum hydroxide, talc, and titanium dioxide.

21. The smoking article of claim 20 in which said whitener is titanium dioxide.

22. The smoking article of claim 16 in which said wrapper comprises about 30 percent to about 40 percent by weight of said binder.

23. The smoking article of claim 16 in which said binder of said wrapper comprises a mixture of methyl cellulose and cellulose acetate.

24. The smoking article of claim 16 in which said wrapper inludes from about 2 percent to about 15 percent by weight of a plasticizer.

25. The smoking article of claim 24 which includes from about 6 percent to about 12 percent by weight of a plasticizer.

26. The smoking article of claim 24 in which said plasticizer comprises a mixture of 1,3-butylene glycol, propylene glycol and glycerin.

* * * * *